US006845844B1

(12) United States Patent
Williams

(10) Patent No.: US 6,845,844 B1
(45) Date of Patent: Jan. 25, 2005

(54) FIRE ESCAPE APPARATUS

(76) Inventor: Kevin David Williams, 40 Bryn Mawr Avenue, Ammanford (GB), SA18 20A ( * ) Notice: Subject to any disclaimer, the term of this patent is extended or adjusted under 35 U.S.C. 154(b) by 0 days.

(21) Appl. No.: 10/088,815

(22) PCT Filed: Sep. 21, 2000

(86) PCT No.: PCT/GB00/03650

§ 371 (c)(1),
(2), (4) Date: Jul. 23, 2002

(87) PCT Pub. No.: WO01/21926

PCT Pub. Date: Mar. 29, 2001

(30) Foreign Application Priority Data

Sep. 21, 1999 (GB) ..... 9922185

(51) Int. Cl.[7] ..... A62B 1/06
(52) U.S. Cl. ..... 182/70; 182/76
(58) Field of Search ..... 182/70, 73, 74, 182/71, 76, 196, 194; 114/362

(56) References Cited

U.S. PATENT DOCUMENTS

| | | | | | |
|---|---|---|---|---|---|
| 2,536,966 | A | | 1/1951 | Teller | 228/44 |
| 2,990,908 | A | | 7/1961 | Wozniak | 182/70 |
| 3,012,626 | A | | 12/1961 | Marryatt | 182/70 |
| 3,847,246 | A | * | 11/1974 | Banner | 182/70 X |
| 5,018,600 | A | * | 5/1991 | Sobczak | 182/70 |
| 5,372,217 | A | * | 12/1994 | Hsu | 182/70 |
| 5,467,841 | A | * | 11/1995 | Krumal | 182/70 |
| 6,015,027 | A | * | 1/2000 | Banks | 182/70 |
| 6,029,771 | A | * | 2/2000 | Keown | 182/196 |
| 6,102,155 | A | * | 8/2000 | Hood et al. | 182/76 |
| 6,129,178 | A | * | 10/2000 | Shupp, Jr. | 182/76 |
| 6,135,239 | A | * | 10/2000 | Martin et al. | 182/70 |
| 6,382,352 | B1 | * | 5/2002 | Dowe, Sr. | 182/70 |

FOREIGN PATENT DOCUMENTS

| | | |
|---|---|---|
| DE | 72 092 C | 5/1893 |
| DE | 215 843 C | 7/1907 |
| GB | 1049607 A | 11/1966 |
| GB | 2204629 A | 11/1988 |
| GB | 2222848 A | 3/1990 |

* cited by examiner

*Primary Examiner*—Hugh B. Thompson, II
(74) *Attorney, Agent, or Firm*—Waddey & Patterson; Emily A. Shouse

(57) ABSTRACT

Fire escape apparatus suitable for use in locations where escape requires a movement from a first level to a second lower level is described. The apparatus comprises a casing (40), a flexible ladder (14, 16), and a means for deploying said ladder (11, 22, 24). The casing (40) has a mouth and is of sufficient dimensions to contain the flexible ladder (14, 16) when not in use. The deployment means (11, 22, 24) includes a spacer means (22, 24) and one or more handle means (11). The deployment means may be reversibly reconfigured between a storage configuration and a deployed configuration. The casing may be built into the structure which is to be escaped from, and the ladder is protected, when not in use, by the casing.

41 Claims, 5 Drawing Sheets

FIRE ESCAPE APPARATUS

This application is a continuation of International Application No. PCT/GB00/03650, filed Sep. 21, 2000.

This application relates to fires escape apparatus and in particular to fire escape apparatus suitable for use in locations where escape requires a movement from a first level to a second lower level.

Various types of fire escape which allow humans to escape from a fire by moving from a first level to a second lower level have been proposed. Such fire escapes may be split into two broad categories: fixed and deployable. Fixed fire escapes generally have a permanent structure. They generally comprise a ladder and/or stairs permanently fixed in position to the outer face of a building or other structure. This application is not concerned with fixed fire escapes.

Deployable fire escapes are generally stored within a building or other structure and only deployed at such time as they are needed. The present invention relates to a new deployable fire escape.

According to the present invention there is provided a fire escape apparatus suitable for use where escape requires a movement from a first level to a second lower level. The fire escape apparatus comprises a casing, a flexible ladder and a means for deploying said ladder; in which the casing has a mouth and is of sufficient dimension to contain the flexible ladder when that ladder is not in use. The deployment means includes a spacer means, also referred to as a spacer, and one or more handle means, also referred to as a handle. The deployment means may be reversibly reconfigured between a storage configuration and a deployed configuration.

It is most preferred that the casing has a base, first and second side walls and front and back walls extending between the first and second side walls. In this configuration the mouth of the casing is an aperture between the side walls and the front and back walls opposite the base. The mouth allows access to the inside of the casing from outside the casing. It is particularly preferred that an edge of each of the side and front and back walls are joined to the base. Most preferably, the joints between the walls and/or the base are gas and liquid tight. It is preferred that the material forming the base and the walls of the casing is likewise gas and liquid tight. Most preferably, the material of the casing is also fire proof. Sheet metal is a particularly preferred material for the casing.

In a preferred embodiment each handle means has an associated handle channel either located within the casing, on an outside face of the casing, or integral with a wall of the casing. Each handle channel is preferably dimensioned and configured to allow reversible movement of a handle means along said channel. It is most preferred that the handle means moves along the handle channel when the deployment means is reconfigured.

It is most preferable that a portion of each handle means projects from the end of the handle channel associated with the handle means when the deployment means is in the deployed configuration. This is particularly desirable because it is often the case that a user of the fire escape apparatus will need something to hold on to whilst climbing onto the top of the flexible ladder which has, by then, been deployed. The presence of one or more handle means makes the act of climbing onto the flexible ladder considerably safer and easier.

In one embodiment it is preferred that portions of the handle means project in a direction away from the casing. Most preferably, the handles project out of the casing in the region of the mouth of the casing, or through the mouth of the casing.

A or each handle means may include means adapted to aid a user to locate the apparatus of the present invention once the deployment means is in the deployed position. Such means may include a flashing light or means for producing an audible signal such as pulses of sound.

Each handle channel or handle means may be provided with one or more stop means that serve to limit the movement of the handle within the handle channel. That limitation is most preferably to movement between a stored position and a deployed position. The stop means are most preferably in the form of projections into the channel that obstruct movement of the handle in the handle channel, or projections attached to the handle projecting into a slot in the handle channel, said slot having closed ends, or other means of obstructing the travel of the projections along the slot.

The spacer means is preferably constructed and configured to move from a storage position to a deployed position. It is most preferred that the movement of the spacer means between the stored position and deployed position occurs when the deployment means is reconfigured between its storage configuration and deployed configuration, or the reverse re-configuration.

The purpose of the spacer means is to, when deployed, hold the flexible ladder a predetermined distance away from the casing. In use this equates to the spacer means holding the flexible ladder a predetermined distance away from the face of the building or other structure to which the fire escape apparatus is attached. Holding the flexible ladder away from the face of the building or other structure to which the fire escape apparatus is fixed has the benefit of rendering use of the flexible ladder safer and easier.

It is preferred that the spacer means when in the storage position is at least partially within the casing, most preferably it is substantially within the casing.

The spacer means may be pivotally engaged with at least one handle means. In this embodiment, the spacer means may pivot relative to the handle means when the deployment means is reconfigured. In one particularly preferred embodiment of the present invention the handle means and a portion of the spacer means rest substantially adjacent to each other when in the storage position. When the deployment means is reconfigured to the deployed position, the spacer means pivots about a pivot on the handle means through a predetermined angle.

In a most preferred embodiment, the spacer means comprises first and second lateral bars disposed substantially parallel to each other, each lateral bar being pivotally engaged with a handle means substantially at a first end of the lateral bar and being fixed to a spacer bar extending between said first and second lateral bars substantially at or adjacent to the second end of said lateral bars. Most preferably the spacer means has, when viewed from a position substantially perpendicular to a plane passing through both lateral bars and the spacer bar, the appearance of three sides of a rectangle or square. In use, the flexible ladder rests against the spacer bar, and the lateral bars hold the spacer bar out from the face of the building or other structure.

Optionally, in a further embodiment, each lateral bar includes a grip portion at or adjacent to the second end of the lateral bar. The grip portion may be attached to the lateral bar by normal attachment means, or may be integral with the lateral bar. The grip portion is preferably of such dimensions and configuration as to allow a human hand to obtain a good grip on that portion.

In a preferred embodiment the deployment means further includes a second ladder means, also referred to as a second ladder. The second ladder means is shorter than the flexible ladder and the second ladder means is adapted to move from a storage position to a deployed position on re-configuration of the deployment means.

The second ladder is preferably stored at least partially, and preferably substantially, within the casing when in the storage position.

The second ladder means preferably includes at least one ladder support means, at least one rung and at least one rung support means. The ladder support means may be pivotally engaged with at least one handle means and pivot relative to the handle means when the deployment means is reconfigured.

It is most preferred that the ladder support means comprises first and second support bars disposed substantially parallel to each other, each support bar being pivotally engaged with a handle means substantially at a first end of the support bar and engaged with a rung support means substantially at the second end.

It is most preferred that the spacer means and the ladder support means are each pivotally attached to the same pivot means on each handle means to which they are attached. This reduces the number of pivot points within the apparatus and simplifies mechanical construction. Most preferably the spacer means and the ladder support means pivot around each pivot to which they are attached in opposite directions when the deployment means is reconfigured. Thus if in the storage position the or each handle means, the spacer means, and the ladder support means are all substantially co-planar; when the deployment means is reconfigured the handle means moves, but remains in the same plane, and the spacer means and the ladder support means move to positions either side of that plane.

It is preferred in one embodiment that at least one pivot is provided with means to limit the degree of rotation of one or both of the spacer means and ladder support means. It is particularly preferred that each of the spacer means and ladder support means may pivot through approximately 90° relative to the handle means. In one embodiment, the handle means is substantially straight, and the spacer means and the ladder support means are configured so that they have a small dimension in a first direction compared to the dimensions in a second and third direction when the first, second and third directions are mutually perpendicular. In this embodiment the handle means, ladder support means, and spacer means can move from the stored position in which they are substantially co-planar to the deployed position, when the spacer means and ladder support means are again substantially co-planar, but on opposite sides of the axis about which they have pivoted, and the handle means is orientated substantially perpendicularly to the plane of the spacer means and ladder support means.

Alternatively, or in addition to stops being provided on the pivot means, stop means may be located on the spacer means and/or ladder support means.

In the most preferred embodiment of the present invention there are two handle means. When those handle means are in the deployed position, at least a portion of the mouth of the casing is located between the handle means. Most preferably, the handle means have a substantially straight longitudinal axis and a first end of the handle means is configured to be easily gripped in a human hand. Preferably, the majority of each handle is substantially circular in cross section except for at the first end of the handle means.

The flexible ladder may be of any appropriate ladder construction. Most preferably it is comprised of a plurality of rungs, said rungs being fixed at substantially even spacings to a pair of longitudinal flexible rung supports. Said rung supports can be steel wire, chain, or other non-flammable flexible structure.

It is preferred that a first end of the ladder is attached to the base of the casing. Such attachment may be by standard means such as bolts, welding, or other appropriate means. The second end of the flexible ladder is most preferably provided with means adapted to releasably engage with the spacer means. When the second end of the flexible ladder is so configured, the movement of the spacer means from its stored position to its deployed position causes the second end of the ladder to be pulled through the mouth of the casing. Once the second end of the ladder has been pulled through the mouth of the casing, a user of the fire escape apparatus may then use the portion of the ladder pulled through the mouth of the casing to pull the remainder of the ladder out of the casing. In practice it will be found that because of the weight of the ladder, once a certain amount of the ladder has been pulled out of the casing and allowed to hang down the face of the structure to which the fire escape apparatus is attached, the weight of the deployed ladder will be sufficient to cause the remainder of the ladder to be deployed without further intervention from the user.

The fire escape apparatus of the present invention is, in a further preferred embodiment, provided with a removable closure means for the mouth of the casing. The closure means may, if so desired, be provided with seal means to cause the closure of the casing to be substantially fluid or gas tight.

In use, the presence of a closure member closing the mouth of the casing when the deployment means is in the storage position and the flexible ladder is within the casing is preferable because the closure member will prevent unwanted dirt, rubbish or other material from entering the casing and potentially jamming the deployment means or the flexible ladder within the casing. Where the apparatus of the present invention is to be used in environments that are wet and/or hostile to the materials from which the apparatus is constructed, it is preferred that the closure member includes an appropriate seal means to prevent such a hostile environment damaging the apparatus of the present invention and, possibly, rendering it unserviceable.

The closure member is preferably provided with one or more releasable latch means to latch the closure member in a closed position.

In the most preferred embodiment of the present invention, the deployment means is provided with means or an energy source which can be utilized to cause the re-configuration of the deployment means from its stored position to its deployed position to occur without a user of the apparatus having to physically manipulate the apparatus. Most preferably this energy is provided by biasing. The biasing means may be one or more compression springs, each of those springs are held in a compressed state by a latch means, also referred to as second latch means, until the actuation means causes release of the latch means. In alternative embodiments, the energy necessary to cause the deployment means to reconfigure may be obtained from a compressed gas source, a source of electricity, or any other appropriate energy storage means or source.

It is most preferred, when the casing is provided with a closure means, that the actuation means for the energy source be activated when the closure means is removed from the casing.

In an alternative embodiment, the actuation means for the energy source is activated from a position or by means remote from the apparatus of the present invention. The means may include a fire alarm system for a building, or a user operated switch.

The apparatus of the present invention may also include one or more alert means. The alert means preferably detect and react to either the removal of the closure means from the casing, if present, or the re-configuration of the deployment means. The alert means may communicate the occurrence of the event that it is designed to detect by one or more of: communicating the occurrence of the event to an emergency service such as the fire service; cause a fire alarm to sound; or cause a local indication that the detected event has occurred, for example in the form of a flashing light source. The alert means may communicate the occurrence of an event via either electromagnetic radiation signals, or via fixed, solid state wiring.

The apparatus of the present invention may be used in a wide variety of locations and with a wide variety of structures. It is particularly preferred, however, that the apparatus of the present invention be used in buildings which include a structural frame, an inner skin and an outer skin. The apparatus is configured to be fixed to the structural frame and located between the inner and outer skins. The apparatus is preferably orientated so that the mouth of the casing faces substantially upwards and the apparatus is fixed beneath an aperture in the inner and outer skins. Most preferably, this aperture is a window. In this instance, the casing is provided with a closure means which also forms at least part of the window sill when the closure means is closing the mouth of the casing.

A particular advantage of using the apparatus of the present invention in the above described fashion is that the fire escape apparatus can be built into the fabric of a building when the building is constructed and can remain there until such time as it is necessary, if at all. The appearance of the inner skin of the building, e.g. the inner wall of a room, is not in any way detracted from by the apparatus of the present invention. This will make fitting apparatus of the present invention into a building much more cosmetically acceptable than has been the case in connection with previously known fire escape apparatus.

In an alternative embodiment of the apparatus of the present invention, whichever of the front or back walls of the casing that is to face toward the inside of the building can either be constructed to include one or more fluid tight passages interconnected with each other, an input port and an output port so as to form a radiator for use as part of a central heating system. Alternatively, a wall of the casing can be so configured to allow the mounting of a radiator onto that wall. In this embodiment, the radiator hides the apparatus of the present invention.

A second location within a building that it may be desired to fit the apparatus of the present invention is within a parapet wall at the top of a flat roofed building, or around a balcony. Again, because the apparatus of the present invention can be built into the parapet wall there is no unsightliness caused by the apparatus of the present invention and, as such, its presence in a building is much more acceptable than previously known fire escapes.

An alternative preferred location for apparatus of the present invention is use on sailing vessels or ships or boats. Most preferably the apparatus could be fixed to the hull of the sailing vessel adjacent to the junction of the hull and a deck. The apparatus should be fixed either beneath an aperture in the hull, if it is being fixed below the top deck, or just below the top edge of the hull.

Where the apparatus is to be used on a sailing vessel, it is particularly important that the casing is provided with a closure means and that there is a seal on that closure means. It is undesirable for sea water to enter the casing and risk corroding the flexible ladder and/or deployment means when they are in their storage position.

In use, a user will go to wherever the apparatus is situated. He will remove the closure means to the casing (if one is employed), and either cause actuation of the energy source to cause the deployment means to move to its deployed position, or physically manipulate the deployment means to move it to its deployed position. Once the deployment means is at its deployed position, the user will pull the flexible ladder out of the casing and lower it down the side of the structure to be escaped from, whilst draping it over the spacer means. The weight of the ladder causes the deployment of the remainder of the flexible ladder without further intervention from the user once sufficient of the flexible ladder has been deployed.

If the embodiment of the apparatus that the user is using includes the second ladder means, that second ladder means will be caused to deploy in the opposite direction from the spacer means and will deploy a second ladder down the inside face of the structure to be escaped from. When the flexible ladder is fully deployed the user may climb up the second ladder whilst holding on to the handle means, transfer himself from the second ladder to the flexible ladder, and then climb down the flexible ladder so escaping the fire.

The fire escape means of the present invention may be repacked into the casing by a reverse procedure to deploying the fire escape means. The flexible ladder will have to be pulled up to the level of the apparatus and if compression springs are used as the energy source for the deployment means, those springs will have to be recompressed. Thus the fire escape apparatus of the present invention may be re-used or deployed on a regular basis to ensure that it remains in working order.

The present invention will be further described and explained by way of example and with reference to the accompanying drawings in which.

Figure 1:
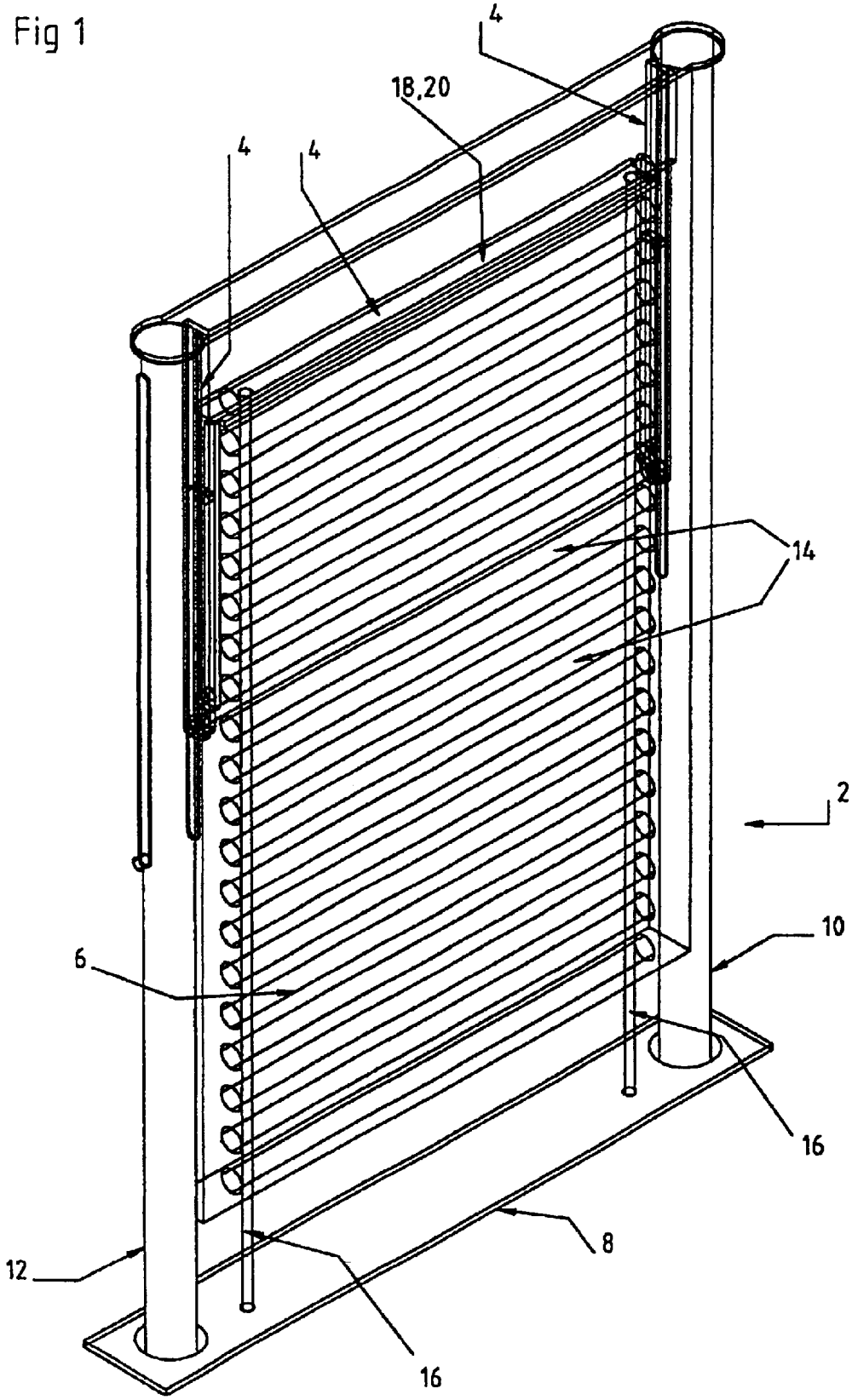
FIG. 1 shows a perspective view of an embodiment of the apparatus of the present invention when the deployment means is in the storage position.

With reference to FIG. 1, a fire escape apparatus (2) is comprised of a deployment means (4), a flexible ladder (6) and a casing (not shown). The casing includes base plate (a) and extends between a first and second handle channel (10, 12). The casing is omitted from FIG. 1 for clarity.

Flexible ladder (6) is composed of a number of rungs (14, not all of which are numbered in FIG. 1). Rungs (14) extend between steel rung support cables (16) and are fixed thereto at substantially even spacing. Rung support cables (16) each have a first end connected- to base plate (B) The connection is by way of a standard steel wire connection means.

Figure 3:
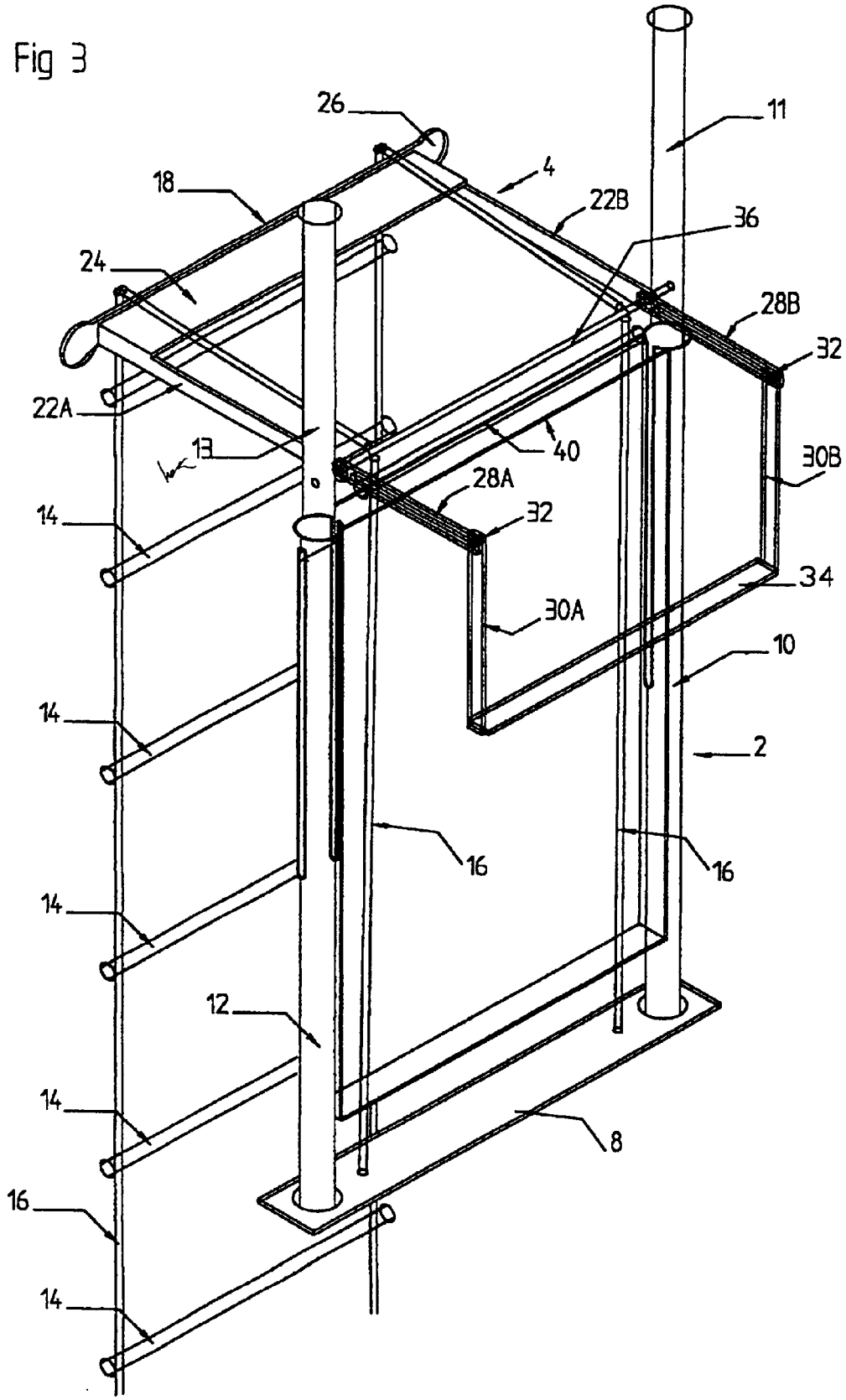
FIG. 3 shows the apparatus of FIG. 1 when the deployment means is in the deployed position.
Figure 5:
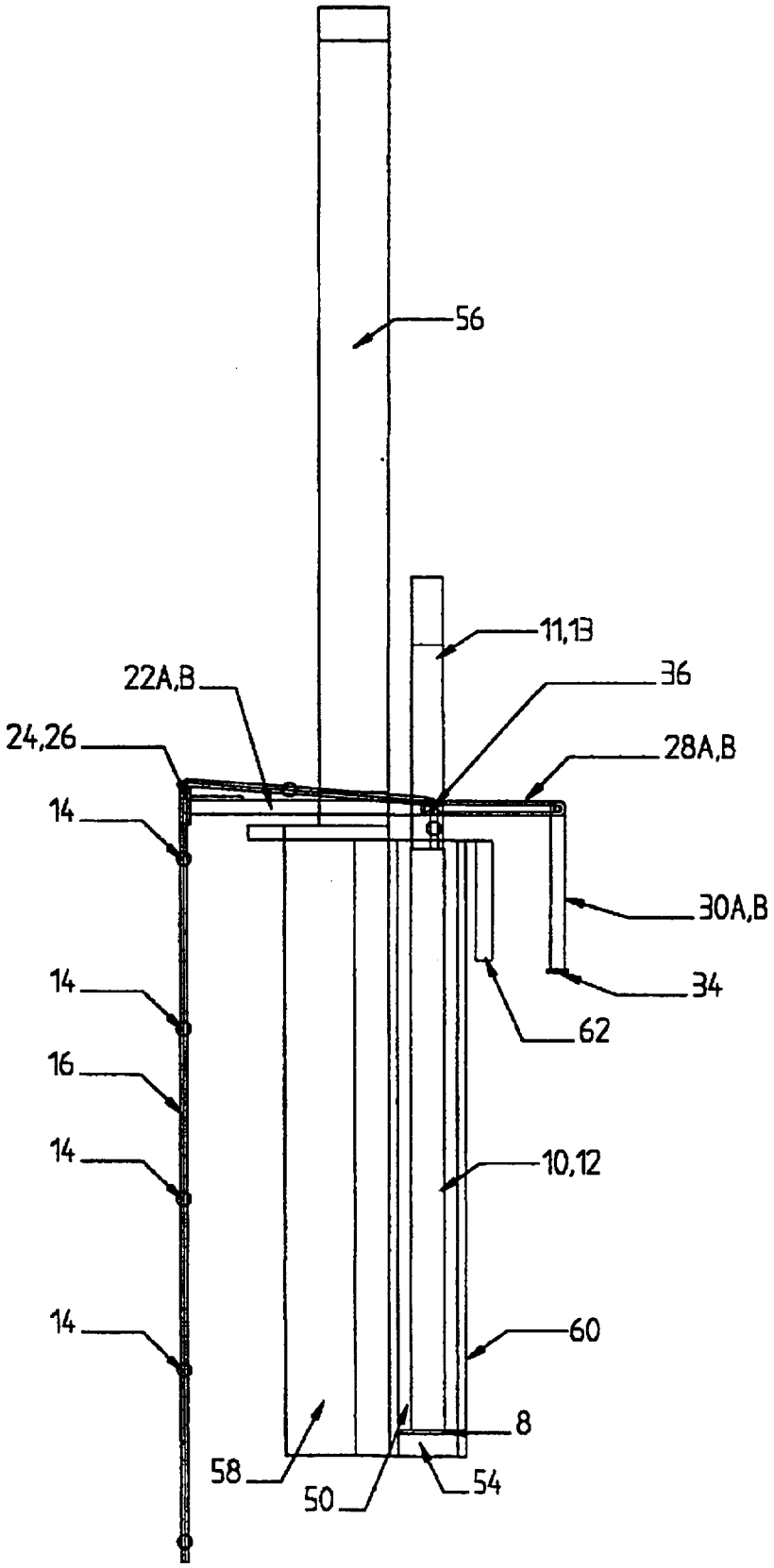
FIG. 5 shows a side elevation of the apparatus of FIG. 4.

Deployment means (4) comprises, as is better illustrated in FIGS. 3 and 5, a spacer means (18) and a second ladder means (20). Spacer means (18) comprises a pair of lateral bars **(22*a*, 22*b*) and a spacer bar (24). Spacer bar (24) is combined with a casing closure means (26). Casing closure means (26) closes the mouth (not shown) of the casing (not shown) through which ladder (26) and deployment means (4) extends when in the deployed position as shown in FIG. 3**.

Second ladder means (20) comprises a pair of ladder support bars (28*a*, 28*b*). Each of ladder support bars (28*a*, 28*b*) is engaged with a rung support bar (30*a*, 30*b* respectively). Rung support bars (30*a*, 30*b*) engage with ladder support bars (28*a*, 28*b*) by way of a pin (32). Each pin (32) is fixed to a rung support bar (30*a*, 30*b*) and engaged in a longitudinal slot that extends along each ladder support bar (28*a*, 28*b*). Pins (32) are dimensioned and configured so that they cannot be withdrawn from the longitudinal slots. Pin (32) is fixed to a first end of the associated rung support bar (30*a*, 30*b*). Fixed to the end of the rung support bar (30*a*, 30*b*) remote from pin (32) is a rung (34). Rung (34) extends between the rung support bars (30*a*, 30*b*).

The length of ladder support bars (28*a*, 28*b*) and rung support bars (30*a*, 30*b*) is determined by the position where the fire escape apparatus (2) is to be located, the dimensions of the structure surrounding that location, and the desired vertical distance between the rung (34) and the mouth of the casing (not shown). In alternative embodiments, not shown, rung support bars (30*a*, 30*b*) may either support further rung support bars and/or further rungs.

Located within each of the handle channels (10, 12) in FIG. 1 is a handle (11, 13 respectively). When the deployment means (4) is in its storage position, the handles (11, 13) are fully retracted into the channels (10 and 12 respectively).

Referring to FIG. 3, a portion of handles (11, 13) may be seen extending from their associated handle channels (10, 12 respectively). Extending between handles (11) and (13) is a pivot bar (36). The ends of pivot bar (36) are fixed within the handles (11 and 13). Lateral bar (22*a*) and ladder support bar (28*a*) are both provided with apertures through which pivot bar (36) passes. The apertures are adjacent to the ends of the bars remote from spacer bar (24) and rung bar (30) respectively. The apertures in lateral bar (22*a*) and ladder support bar (28*b*) are dimensioned so as to allow the bars (22*a*) and (28*a*) to slidingly rotate about pivot bar (36). Apertures of a similar location and dimension are provided in lateral bar (22*b*) and ladder support bar (28*b*).

As may be seen from FIG. 3, when deployment means (4) is in the deployed configuration, lateral support bars (22) and ladder support bars (28) have substantially parallel longitudinal axes and are orientated, relative to pivot bar (36) in opposite directions.

Not shown in any of the figures is an energy storage means in the form of a compression spring located in each of handle channels (10) and (12). The compression spring is braced, at a first end, against base plate (8) and engages at a second end with the end of handle (11) and (13) proximal to base plate (8) or the ends of pivot bar (36) inside handles (11) and (13).

When the handles (11 and 13) are fully within the handle channels (10 and 12) the compression springs are under compression. Each of the handle channels (10 and 12) are provided with a latch means (not shown) which acts either on the compression spring itself, or, more preferably indirectly on the compression spring via the handles (11 and 13) or the ends of pivot bar (36). When the latch means are disengaged the compression springs bias the handles (11 and 13) into the position shown in FIG. 2.

Figure 2:
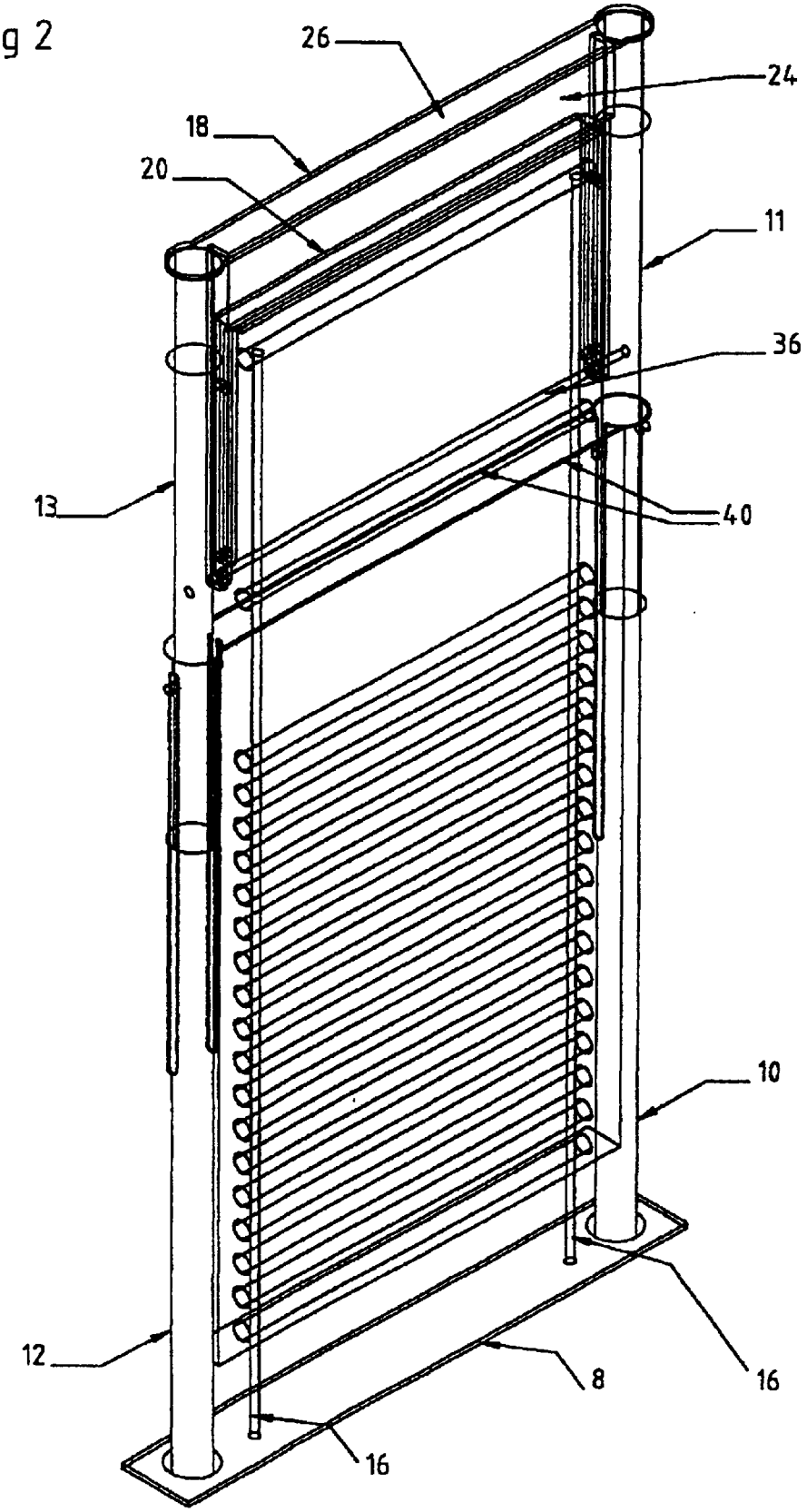
FIG. 2 shows the apparatus of FIG. 1 when the deployment means is between the storage position and the deployed position.

When the handles (11 and 13) reach the position shown in FIG. 2, pivot bar (36) comes clear of the casing, the top edge of which is shown by lines (40) on FIGS. 2 and 3. This allows spacer means (18) and second ladder support means (20) to pivot around pivot bar (36) into the position shown in FIG. 3. Rung support bars (30*a*, 30*b*) and rung (34) may be deployed to the position shown in FIG. 3 from the position shown in FIG. 2 to the position shown in FIG. 3 either by a user pulling the rung (34) away from pivot bar (36) or by biasing means incorporated in ladder support bars (28*a*, 28*b*) (not shown). Gravity then causes rung (34) to hang vertically below the ends of ladder support bars (28*b*).

The rung (14) attached furthest along rung support cable (16) from base plate (8) is, whilst in the storage position shown in FIG. 1 and whilst moving to deployment position as shown in FIG. 3, releasably clipped to spacer bar (24) by clip means (not shown). When the deployment means is in the deployed position shown in FIG. 3, the user unclips the rung (14) from spacer bar (24), and uses rungs (14) to pull ladder (6) out of the casing. The free end of the ladder (6) is passed over spacer bar (24) and allowed simply to drop under the force of gravity. When sufficient of ladder (6) has been passed over spacer bar (24), the weight of ladder (6) will pull the remainder of ladder (6) out of the casing until the rung support cables (16) are taut against the fixings of rung support cables (16) to base plate (8).

Once the flexible ladder has reached the position as shown in FIG. 3, that is with rung support cables (16) held taut, a user of the fire escape apparatus may climb up rung or rungs (34) so that they can climb easily over the apparatus and down flexible ladder (6) via rungs (14) so as to escape a fire. Whilst the user is climbing from rungs (34) to rungs (14) the user may grip one or both of handles (11) and (13) so as to provide balance and increase the safety of the operation.

Once it is no longer required that the apparatus of the present invention be deployed, the apparatus may be returned to its storage configuration. This is done by first placing the flexible ladder back into the casing then returning the deployment means (4) to the position shown in FIG. 2, and finally resetting the energy storage means so that the handles (11, 13) can return to being wholly within the handle channels (10, 12).

Figure 4:
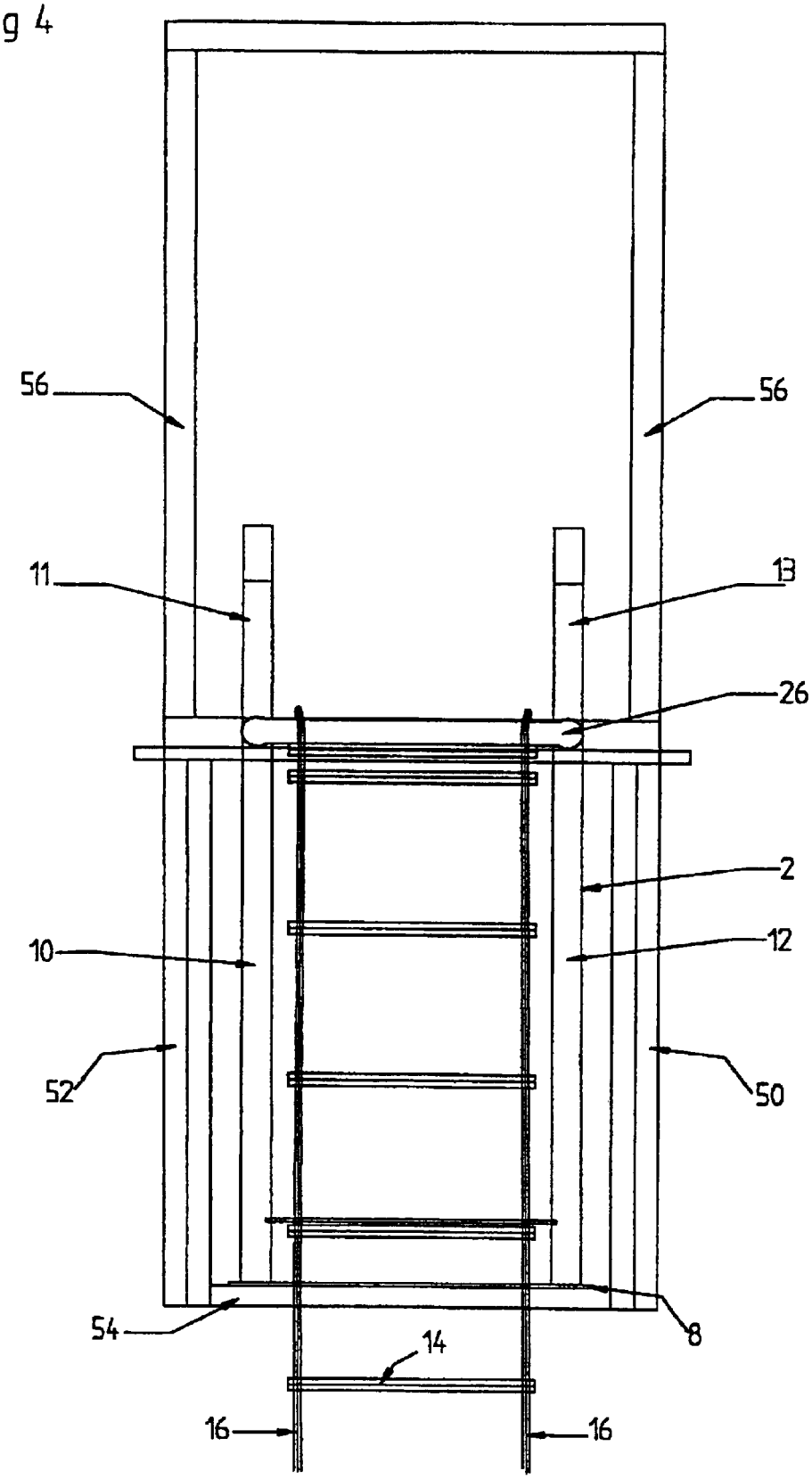
FIG. 4 shows an elevation of the apparatus as in FIG. 3 when located within a building when viewed from outside the building.

In use, as illustrated in FIGS. 4 and 5, the apparatus of the present invention (2) is mounted within a structural framework including a pair of vertical struts (50, 52) either side of the apparatus (2), a beam (54), and a window frame (56). Base plate (8) is bolted (bolts not shown) to beam (54). The apparatus (2) is further provided with stabilising struts (not shown) extending laterally from the casing to the adjacent vertical struts (50, 52). The framework of the struts (50, 52), beam (54) and window frame (56) is typical of a structure to be found in a timber framed house.

The apparatus of the present invention (2) is located between the outer skin (58) of the structure to which the apparatus is attached, and the inner skin (60). The outer skin (58) is comprised of a layer of brickwork, a cavity, and a sheath layer of, for example, plywood. The inner skin (60) is comprised of a layer of plasterboard with a plaster skim over the inner surface of said plasterboard. The apparatus further includes a cover plate (62) that is hinged to the inner skin of the structure (60) and which may move about the hinge line from a position wherein cover plate (62) acts as a part of the window sill for window (56) and hides apparatus (2) to the position shown in FIG. 5 wherein the closure means (26) may be accessed by a user.

The apparatus of the present invention is preferably made of a fire resistant or fire-proof material. In particular, non-flammable metals are preferred because of their ease of mechanical working and their durability. It is particularly anticipated that the apparatus of the present invention may remain in position for long periods of time, and preferably the design life of the structure into which it is incorporated, and accordingly the materials need to be selected to ensure the apparatus has a sufficiently long design life.

What is claimed is:

1. Fire escape apparatus suitable for use in locations where escape requires a movement from a first level to a second lower level comprising a casing having at least one wall, a flexible ladder, and a means for deploying said ladder; in which the casing has a mouth and is configured to contain the flexible ladder when not in use, the deployment means includes a spacer and at least one handle, and in which the deployment means is connected to said casing and is moveable between a storage configuration in which configuration the ladder is inside the casing and a deployed configuration in which the ladder is removed from the casing;

wherein the at least one handle is reversibly moveable between a stored configuration and a deployed configuration.

2. The fire escape apparatus according to claim 1 in which the casing is comprised of a base, and the at least one wall is comprised of first and second side walls, and front and back walls extending between the first and second side walls, and in which the mouth of the casing is an aperture between the inside and out side of the casing, and the mouth is located between the side walls and the front and back walls opposite the base.

3. The fire escape apparatus according to claim 2 in which one edge of each of the side and front and back walls are joined to the base.

4. The fire escape apparatus according to any preceding claim in which the at least, one handle has an associated handle channel located within the casing, each handle channel is dimensioned and configured to allow reversible movement of a handle along the handle channel when the deployment means is reconfigured, and in which a portion of the at least one handle projects from an end of the associated handle channel when the deployment means is in the deployed configuration, and the projecting portion of the at least one handle projects through the mouth of the casing.

5. The fire escape apparatus according to claim 4 in which each channel is provided with stop means to limit the movement of the at least one handle in the channel between a stored position and a deployed position.

6. The fire escape apparatus according to any of claims 1 to 3 in which the at least one handle has an associated handle channel attached to an outside face of, or integral with, said at least one wall of the casing, each handle channel is dimensioned and configured to allow reversible movement of the associated at least one handle along the handle channel when the deployment means is reconfigured, in which a portion of the at least one handle projects from an end of the associated handle channel when the deployment means is in the deployed configuration, and the projecting portion of the at least one handle is adjacent to the mouth of the casing.

7. The fire escape apparatus according to claim 1 in which the spacer is adapted to move from a storage configuration to a deployed configuration.

8. The fire escape apparatus according to claim 7 in which the spacer when in the storage position is at least partially within the casing.

9. The fire escape apparatus according to claim 7 in which the spacer is pivotally engaged with the at least one handle, and the spacer may pivot relative to the at least one handle when the deployment means is reconfigured.

10. The fire escape apparatus according to claim 9 in which the spacer comprises a first and second lateral bar deposed substantially parallel to each other, each lateral bar being pivotally engaged with the at least one handle substantially at a first end and fixed to a spacer bar extending between the first and second lateral bars substantially at or adjacent to the second end.

11. The fire escape apparatus according to claim 10 in which each lateral bar includes a grip portion at or adjacent to the second end of said lateral bar.

12. The fire escape apparatus according to claim 9 in which the deployment means further includes a second ladder, said second ladder being shorter than the flexible ladder, and in which the second ladder is adapted to move from a storage position to a deployed position.

13. The fire escape apparatus according to claim 12 in which second ladder when in the storage position is at least partially within the casing.

14. The fire escape apparatus according to claim 12 in which the second ladder includes at least one ladder support means, at least two rungs, and at least one rung support means, and in which the ladder support means is pivotally engaged with the at least one handle, and the ladder support means pivots relative to the at least one handle when the deployment means is reconfigured.

15. The fire escape apparatus according to claim 14 in which the ladder support means comprises first and second support bars deposed substantially parallel to each other, each support bar being pivotally engaged with a the at least one handle substantially at a first end and engaged with a rung support means substantially at the second end.

16. The fire escape apparatus according to claim 14 in which the spacer and the ladder support means are each pivotally attached to a single pivot means on the at least one handle to which they are attached.

17. The fire escape apparatus according to claim 16 in which the at least one of the pivot means is provided with one or more stop means, said stop means being adapted to limit the angle through which at least one of the spacer and the ladder support means may pivot.

18. The fire escape apparatus according to claim 14 in which the spacer and the ladder support means pivot in opposite directions when the deployment means is reconfigured.

19. The fire escape apparatus according to claim 18 in which the spacer and the ladder support means are each provided with at least one stop means, said stop means being adapted to limit the angle through which the spacer and the ladder support means may pivot relative to either the at least one handle or each other.

20. The fire escape apparatus according to claim 1 in which there are two handles wherein at least a portion of the mouth of the casing extends between the handles when in deployed position.

21. The fire escape apparatus according to claim 1 in which the at least one handle has a substantially straight longitudinal axis, and a first end of the at least one handle is configured so that it is a suitable shape for easy gripping by a human hand.

22. The fire escape apparatus according to claim 1 in which the flexible ladder is comprised of a plurality of rungs, said rungs being fixed at substantially even spacings to a pair of longitudinal flexible rung supports.

23. The fire escape apparatus according to claim 1 in which one end of said flexible ladder is fixed to the base of the casing.

24. The fire escape apparatus according to claim 1 in which one end of said ladder is adapted to releasably engage with the spacer.

25. The fire escape apparatus according to claim 24 in which re-configuration of the deployment means from the storage configuration to the deployed configuration causes the spacer to pull the end of the ladder releasably engaged with the spacer through the mouth of the casing.

26. The fire escape apparatus according to claim 1 in which there is further provided a removable closure means adapted to close the mouth of the casing.

27. The fire escape apparatus according to claim 26 in which the closure means is provided with at least one seal means adapted to produce a substantially liquid and or gas tight seal when the mouth of the casing is closed.

28. The fire escape apparatus according to claim 26 in which the closure means is further provided with at least one latch means adapted to latch the closure means in a closed position.

29. The fire escape apparatus according to claim 28 in which the deployment means further includes a power source adapted to cause the deployment means to be reconfigured from the storage configuration to the deployed configuration once activated by an actuation means.

30. The fire escape apparatus according to claim 29 in which removal of the closure means from the mouth of the casing causes the actuation of an energy source.

31. The fire escape apparatus according to claim 29 in which the energy source is one or more compression springs, each of said springs being held in a compressed state by a second latch means, and in which the actuation means causes release of the second latch means.

32. The fire escape apparatus according to claim 1 in which the apparatus is adapted to be fixed to a building.

33. The fire escape apparatus according to claim 32 in which the apparatus is adapted to be fitted beneath a window of the building.

34. The fire escape apparatus according to claim 32 in which said at least one wall of the casing includes one or more fluid tight passages, interconnected with each other, and an input port and an output port.

35. The fire escape apparatus according to claim 32 in which a building has a structural frame, an inner skin and an outer skin, and in which the apparatus is adapted to be fixed to the structural frame between the inner and outer skins, and the mouth of the casing faces upwards.

36. The fire escape apparatus according to claim 1 in which there is further provided a removable closure means adapted to close the mouth of the casing and in which the apparatus is adapted to be fixed to a building having a structural frame, an inner skin and an outer skin, and in which the apparatus is adapted to be fixed to the structural frame between the inner and outer skins, and the mouth of the casing faces upwards in which the closure means forms a window sill.

37. The fire escape apparatus according to claim 1 in which the apparatus is adapted to be used on a sailing vessel.

38. The fire escape apparatus according to claim 37 in which the apparatus is adapted to be fixed to the hull of the vessel adjacent the junction of the hull and a deck.

39. The fire escape apparatus according to claim 1 in which the apparatus is further provided with means to detect a change in the configuration of, or movement within, the apparatus, and communication means in which the communication means may communicate the detection of that change or movement to a monitoring device, or an indicator means.

40. The fire escape apparatus according to claim 39 in which the communication means send one or more communications via electromagnetic radiation or via fixed wires.

41. The fire escape apparatus according to claim 39 in which the communication means communicates detection of the change or movement to an emergency service or to apparatus which, in turn, causes a fire alarm to sound.

* * * * *